US006234842B1

(12) United States Patent
Keay et al.

(10) Patent No.: US 6,234,842 B1
(45) Date of Patent: May 22, 2001

(54) POWER CONVERTER CONNECTOR ASSEMBLY

(75) Inventors: Gary C. Keay, Merrimack, NH (US); Patrizio Vinciarelli, Boston, MA (US)

(73) Assignee: VLT Corporation, San Antonio, TX (US)

( * ) Notice: Subject to any disclaimer, the term of this patent is extended or adjusted under 35 U.S.C. 154(b) by 0 days.

(21) Appl. No.: 09/197,115

(22) Filed: Nov. 20, 1998

(51) Int. Cl.[7] ..... H01R 13/00

(52) U.S. Cl. ..... 439/620; 439/76.1; 439/485; 361/707; 361/785

(58) Field of Search ..... 439/76.1, 620, 439/485–487; 361/707, 785

(56) References Cited

U.S. PATENT DOCUMENTS

| | | | |
|---|---|---|---|
| 3,334,395 | 8/1967 | Cook et al. | 29/625 |
| 3,621,338 | 11/1971 | Rogers | 317/101 CC |
| 3,683,241 | 8/1972 | Duncan | 317/234 |
| 4,138,711 | 2/1979 | Bremenour et al. | 361/424 |
| 4,400,762 | 8/1983 | Bartley et al. | 361/402 |
| 4,417,296 | 11/1983 | Schelhorn | 361/386 |
| 4,531,145 | 7/1985 | Wiech, Jr. | 357/81 |
| 4,551,746 | 11/1985 | Gilbert et al. | 357/74 |
| 4,551,747 | 11/1985 | Gilbert et al. | 357/74 |
| 4,622,621 | 11/1986 | Barre | 361/382 |
| 4,724,283 | 2/1988 | Shimada et al. | 174/68.5 |
| 4,740,414 | 4/1988 | Shaheen | 428/210 |
| 4,741,472 | 5/1988 | Barmann | 228/180.1 |
| 4,750,089 | 6/1988 | Derryberry et al. | 361/388 |
| 4,769,525 | 9/1988 | Leatham | 219/209 |
| 4,783,695 | 11/1988 | Eichelberger et al. | 357/65 |
| 4,783,697 | 11/1988 | Benenati et al. | 357/80 |
| 4,842,552 | 6/1989 | Frantz | 439/557 |
| 4,847,136 | 7/1989 | Lo | 428/195 |
| 4,879,630 | 11/1989 | Boucard et al. | 361/386 |
| 4,918,811 | 4/1990 | Eichelberger et al. | 29/840 |

(List continued on next page.)

FOREIGN PATENT DOCUMENTS

| | | |
|---|---|---|
| 141 582 B1 | 9/1988 | (EP) . |
| 367 903 B1 | 3/1993 | (EP) . |
| 2 214 731 | 9/1989 | (GB) . |

OTHER PUBLICATIONS

Data Sheet: Model V375A48C600A DC–DC Converter, Vicor Corp., company advertisement, 1998/1999.

*Primary Examiner*—Gary F. Paumen
(74) *Attorney, Agent, or Firm*—Fish & Richardson P.C.

(57) ABSTRACT

The invention features an apparatus, which allows a power converter module to be easily connected and disconnected from an external device and includes an electronic component. The apparatus includes a connector for making an electrical connection to a terminal on the power converter, a component interface subassembly which provides for making connections to the electronic component and an enclosure which encloses the electronic component and the connector. The component interface subassembly may include a thermally conductive plate which provides a low thermal impedance path for removing heat from the electronic component. The electronic component may be an OR diode or a MOSFET which may be connected in series between the power converter output and the external device. The apparatus may be attached to a heat sink for efficient removal of heat.

49 Claims, 16 Drawing Sheets

U.S. PATENT DOCUMENTS

| | | | |
|---|---|---|---|
| 4,953,005 | 8/1990 | Carlson et al. | 357/80 |
| 4,959,750 | 9/1990 | Cnyrim et al. | 361/401 |
| 4,975,824 | 12/1990 | Huss et al. | 363/132 |
| 4,994,215 | 2/1991 | Wiech, Jr. | 264/27 |
| 5,006,673 | 4/1991 | Freyman et al. | 174/255 |
| 5,019,941 | 5/1991 | Craft | 361/386 |
| 5,019,946 | 5/1991 | Eichelberger et al. | 361/414 |
| 5,028,987 | 7/1991 | Neugebauer et al. | 357/80 |
| 5,200,884 | 4/1993 | Ohashi | 361/401 |
| 5,352,851 | 10/1994 | Wallace et al. | 174/52.4 |
| 5,365,403 | 11/1994 | Vinciarelli et al. | 361/707 |
| 5,394,300 | 2/1995 | Yoshimura | 361/737 |
| 5,673,181 * | 9/1997 | Hsu | 439/76.1 |
| 5,797,771 * | 8/1998 | Garside | 439/76.1 |
| 5,836,774 * | 11/1998 | Tan et al. | 439/76.1 |

* cited by examiner

POWER CONVERTER CONNECTOR ASSEMBLY

BACKGROUND OF THE INVENTION

This invention relates to a power converter connector assembly.

In network systems which require high reliability in power conversion, such as computer networks in banks, hospitals, and airports, multiple power converter modules are employed to implement fault tolerant redundancy (see U.S. Pat. No. 5,694,309, incorporated by reference). The power conversion circuitry includes components which monitor parameters, such as input voltage, operating temperature, and internal operating parameters. If any of these parameters is outside an allowable operating range the power converter is isolated and disabled.

One way to provide for automatic isolation is to include an OR diode in series with the positive output of a power converter to isolate the power converter from the common output bus, in case of failure, and to allow connection of a replacement power converter without interruption in the network operation.

Referring to FIG. 1, the positive outputs of an array of three power converters 70, 72, and 74, are connected in series with forward biased OR diodes 71, 73, and 75, respectively. The diodes 71, 73, and 75 are connected to a common output voltage bus 79 which provides power to load 80. The array is fault-tolerant in that the diodes will isolate a failed module from the output voltage bus 79 and failure of one or more of the converter modules will not interrupt delivery of power to the load 80, provided that the load power does not exceed the combined power ratings of the remaining, operating, converters.

SUMMARY OF THE INVENTION

In general, in one aspect, the invention features an apparatus for electrically connecting a power converter to an external device. The apparatus includes a connector for making an electrical connection to a terminal on the power converter, a component interface subassembly having an electronic component and an enclosure receiving the connector and the component interface subassembly.

Implementations of the invention may include one or more of the following features. The electronic component may be a diode or a MOSFET. The component interface subassembly may connect the electronic component to the connector. The apparatus may further have a wire for making electrical connection to the external device. The external device may be a load and the electronic component may be connected in series between the load and the power converter output terminal.

The component interface subassembly may include a thermally conductive plate and the electronic component may be thermally coupled to the thermally conductive plate. A surface of the thermally conductive plate may form a portion of the outside surface of the enclosure. The thermally conductive plate may be aluminum or zinc.

The terminal may be a pin and the connector may be an electrical socket for receiving the pin. The socket may be connected to a printed circuit board within the enclosure. The printed circuit board may have a conductive trace, and the trace may have one end connected to the electrical socket and a free end for making electrical connections. The wire may be connected to the free end of the conductive trace. A termination on the electronic component may connect to the free end of the conductive trace. The wire may connect to the electronic component. The wire may be connected to a termination on the component other than the termination to which the free end of the conductive trace is connected. The electronic component may be a semiconductor diode. The wire may be part of a cable having insulated wires.

The enclosure may include a body having a top surface, a bottom surface and at least one opening passing through the top surface and the bottom surface and being adapted to receive a fastener for securing the apparatus to another device. The other device may be a heat sink or the power converter. The enclosure may be polyphenylene sulfate. The connector may be located within the enclosure and inset from an aperture in a surface of the enclosure. The enclosure may have parts which are fastened together. The enclosure may further have at least one opening adapted to receive and retain a fastener for securing the apparatus to the power converter. The fastener may be a screw having a head, and an elongated member attached to the head and the elongated member may have a smooth portion adjacent to the head and a threaded portion.

The power converter may have a threaded opening adapted to receive the threaded portion of the screw. Rotation of the screw in a one direction may advance the screw in a longitudinal direction into the threaded opening and engage connector sockets to power converter output pins. Rotation of the screw in the opposite direction may withdraw the threaded portion of the screw in a longitudinal direction out of the threaded opening and disengage the connector sockets from the power converter output pins. The smooth portion of the screw may be surrounded by a washer. The washer may be permanently affixed within the opening of the enclosure and may have an inner diameter smaller than an outer diameter of the threaded portion thus retaining the screw within the enclosure.

The component interface subassembly may include a thermally conductive plate, a first insulation layer, a metal layer, an insulating plate, a metal plate, a first ceramic substrate, and a first component. The thermally conductive plate may have top and bottom surfaces. The first insulation layer may have top and bottom surfaces and the bottom surface may be in contact with the top surface of the thermally conductive plate. The metal layer may have top and bottom surfaces and the bottom surface may be in contact with the top surface of the first insulation layer. The insulating plate may have top and bottom surfaces and the bottom surface may be in contact with the top surface of the metal layer. The metal plate may have top and bottom surfaces and the bottom surface may be in contact with the top surface of the insulating plate. The first ceramic substrate may have top and bottom surfaces and the bottom surface may have a metallic film which is bonded to the top surface of the metal layer, and the top surface may have metallic pads covered with a metallic film. The first component may be mounted on top of the first ceramic substrate surface and may have terminations which are connected to the pads.

The component interface subassembly may further include a first conductive strap connecting a first pad on the top surface of the first ceramic substrate with the top surface of the metal layer, a first conductive busbar having a first end attached to a second pad on the first ceramic substrate, and a second conductive busbar having a first end attached to the top surface of the metal layer.

The component interface subassembly may further include a second ceramic substrate having top and bottom surfaces and a second component mounted on the top surface of the second ceramic substrate. The bottom surface may have a continuous metallic film, the film providing a bond of the bottom ceramic substrate surface to the top surface of the metal layer. The top surface may have pads covered with a metallic film and the second component may have terminations which are connected to the pads.

The component interface subassembly may further include a second conductive strap for connecting a first pad on the top surface of the second ceramic substrate with the top surface of the metal layer, and a second end on said first busbar for connecting to a second pad on said second ceramic substrate. The first component may be a diode and a first pad on the first ceramic substrate may be connected to the cathode of the diode and a second pad on the first ceramic substrate may be connected to the anode of the diode. The second component may be a diode and a first pad on the second ceramic substrate is connected to the cathode of the diode and a second pad on the second ceramic substrate is connected to the anode of the diode. The first component may be a MOSFET and the second component may be a semiconductor control device. The metal layer may be a laminate including a layer of silver, a layer of copper and a layer of aluminum. The metallic film on the surface of the first ceramic substrate may include a layer of copper in contact with the ceramic substrate and a layer of gold in contact with a surface of the copper layer opposite the ceramic substrate. The first and second conductive straps and the first and second conductive busbars may be copper. The first and second conductive busbars may be adapted to provide a spring type action. The spring type action may provide for movement of the component interface subassembly relative to the enclosure.

In general, in another aspect, the invention features an apparatus for electrically connecting a power converter to an external device including a connector for making an electrical connection to a terminal on the power converter, a component interface subassembly electrically connected to the connector and having an electronic component, the electronic component connecting to the power converter and the external device through the connector, and a wire having one end connected to the external device.

Implementations of this aspect of the invention may include one or more of the following features. The component interface subassembly may have a heat conductor thermally connecting said electronic component to a heat sink for efficient heat removal. The apparatus may further include an enclosure receiving the component interface subassembly and the connector assembly. A second end of the wire may be connected to the connector or to the electronic component.

In general, in another aspect, the invention features an apparatus for electrically connecting a power converter to an external device including a connector for making an electrical connection to a terminal on the power converter, a component interface subassembly electrically connecting to the connector and having an electronic component and a heat conductor. The electronic component is electrically connected to the power converter and the external device through the connector and thermally connected to a heat sink through the heat conductor.

Implementations of the invention may include one or more of the following features. The apparatus may further include a wire having one end connected to the external device and a second end connected to the connector or to the electronic component. An enclosure may receive the component interface subassembly and the connector assembly.

Among the advantages of the invention may be one or more of the following. The apparatus provides fault tolerance to a power converter module. It is a small package holding the component interface subassembly, a connector and thermal management components. It is also very easy to connect, disconnected, and replace the small size apparatus.

Other features and advantages of the invention will be apparent from the following description of the preferred embodiments, and from the claims.

DESCRIPTION OF THE PREFERRED EMBODIMENTS

Figure 2A:
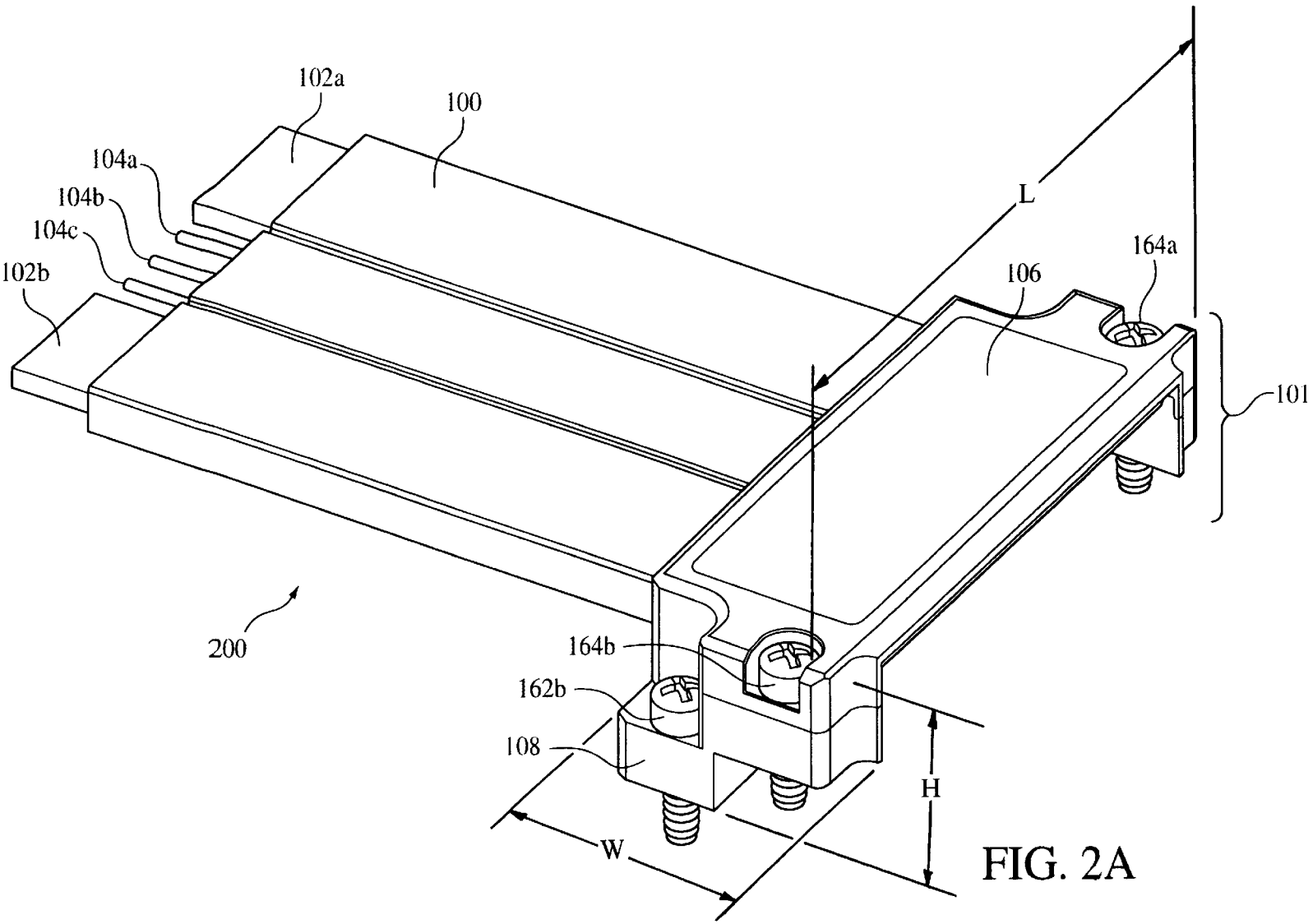
FIGS. 2A and 2B are perspective top and bottom views, respectively, of a connector assembly.
Figure 2B:
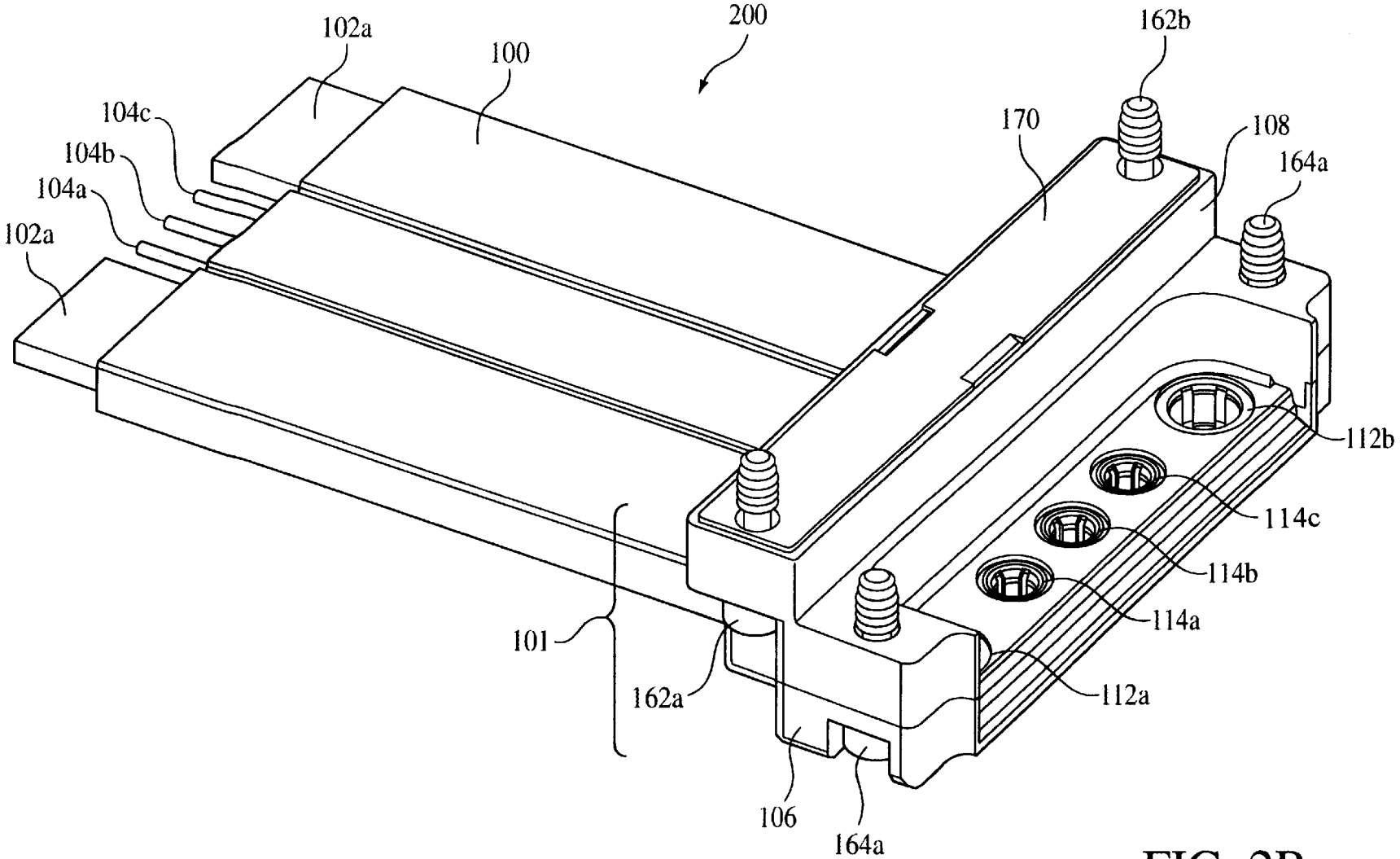

Referring to FIGS. 2A and 2B, a connector assembly 200 features an enclosure 101 comprising a housing 108 (enclosing a component interface subassembly 150, shown in FIGS. 3 and 4), a cover 106 bonded to the housing 108, and a flexible cable 100 emerging from the side of the housing 108. High current sockets 112*a*, 112*b* and low current sockets 114*a*, 114*b*, 114*c*, for making connections to termination pins on a power converter (e.g., power converter 300 high current output pins 302*a*, 302*b* and low current control pins 302*a*, 302*b* and 302*c* in FIG. 4), are inset within apertures in the housing 108. A surface of a thermally conductive plate 170, used for conducting heat away from components enclosed within the enclosure 101, forms a portion of the outer surface of the enclosure. Threaded screws 162*a*, 162*b*, 164*a*, 164*b* are used for mounting the connector assembly 200, as will be described below. The housing 108 and the cover 106 are molded from a glass reinforced polymer, such as polyphenelyne sulfate (PPS), manufactured by Hoechst-Celanese under the trade name Forton ® or by Phillips under the trade name Ryton®. The PPS polymer is rigid enough to provide mechanical stability for the diode assembly and can withstand operating temperatures up to 150° C. The cover 106 is bonded to the housing 108 by ultrasonic welding or an adhesive. The flexible cable 100 has two high current multistrand flat wires 102*a*, 102*b* and three low current multistrand round wires 104*a*, 104*b*, 104*c*. In one example, the connector assembly 200 has a width, W, of 0.785", a height, H, of 0.568" and a length, L, of 2.2".

Figure 3:
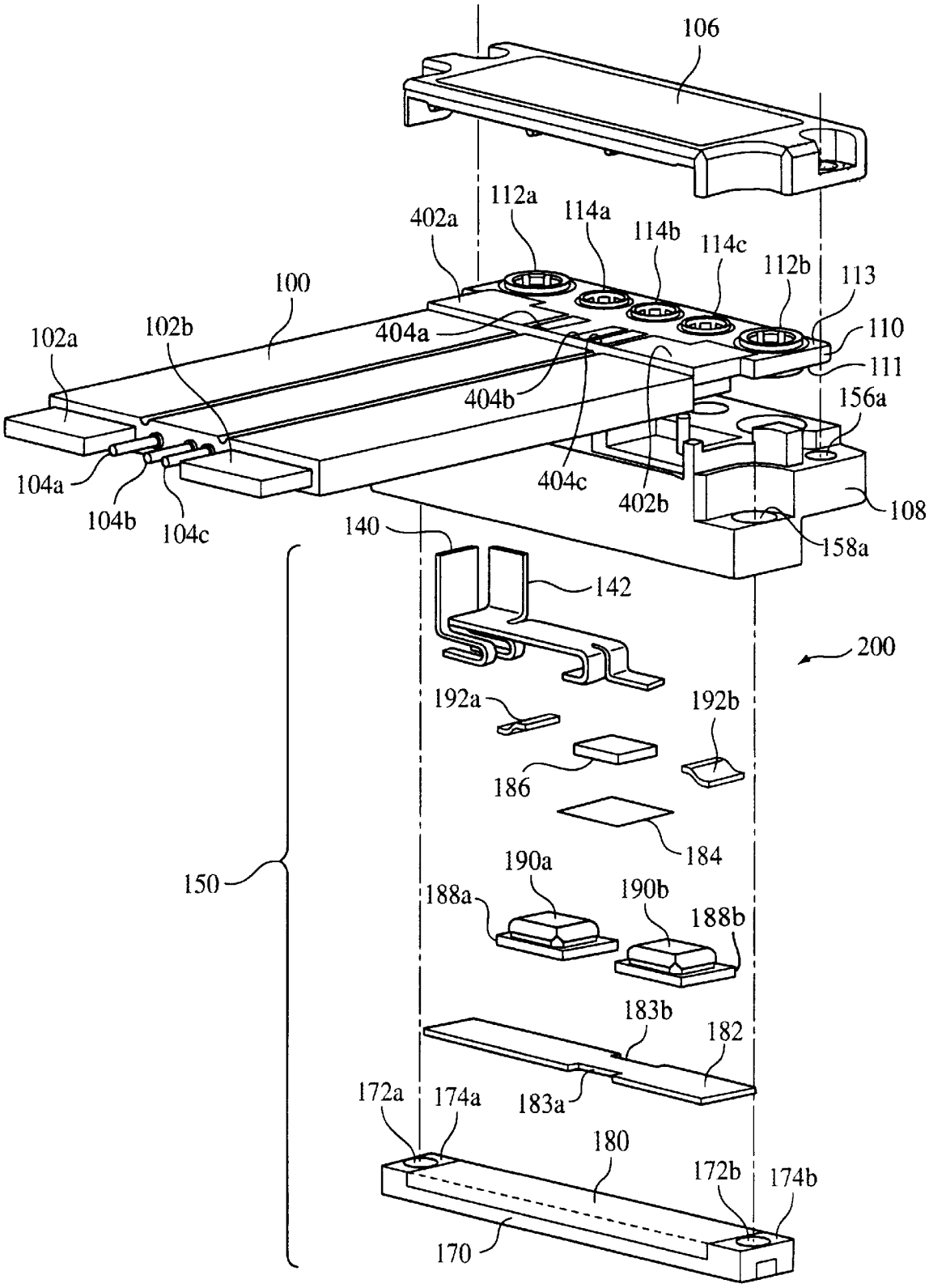
FIG. 3 is an exploded view of the connector assembly of FIGS. 2A and 2B.

Referring to FIG. 3, the flexible cable 100 is attached to a printed circuit board (PCB) assembly 110 by soldering one end of each of the flat wires 102*a*, 102*b* and round wires 104*a*, 104*b*, 104*c* to conductive traces (not shown) on the bottom surface 111 of PCB 110, which correspond to, and are connected by vias with, traces 402*a*, 402*b*, and 404*a*, 404*b*, 404*c*, respectively, on the top surface 113 of the PCB). The other ends of the flat and round wires remains free for making electrical connections to a load or other devices.

Figure 4:
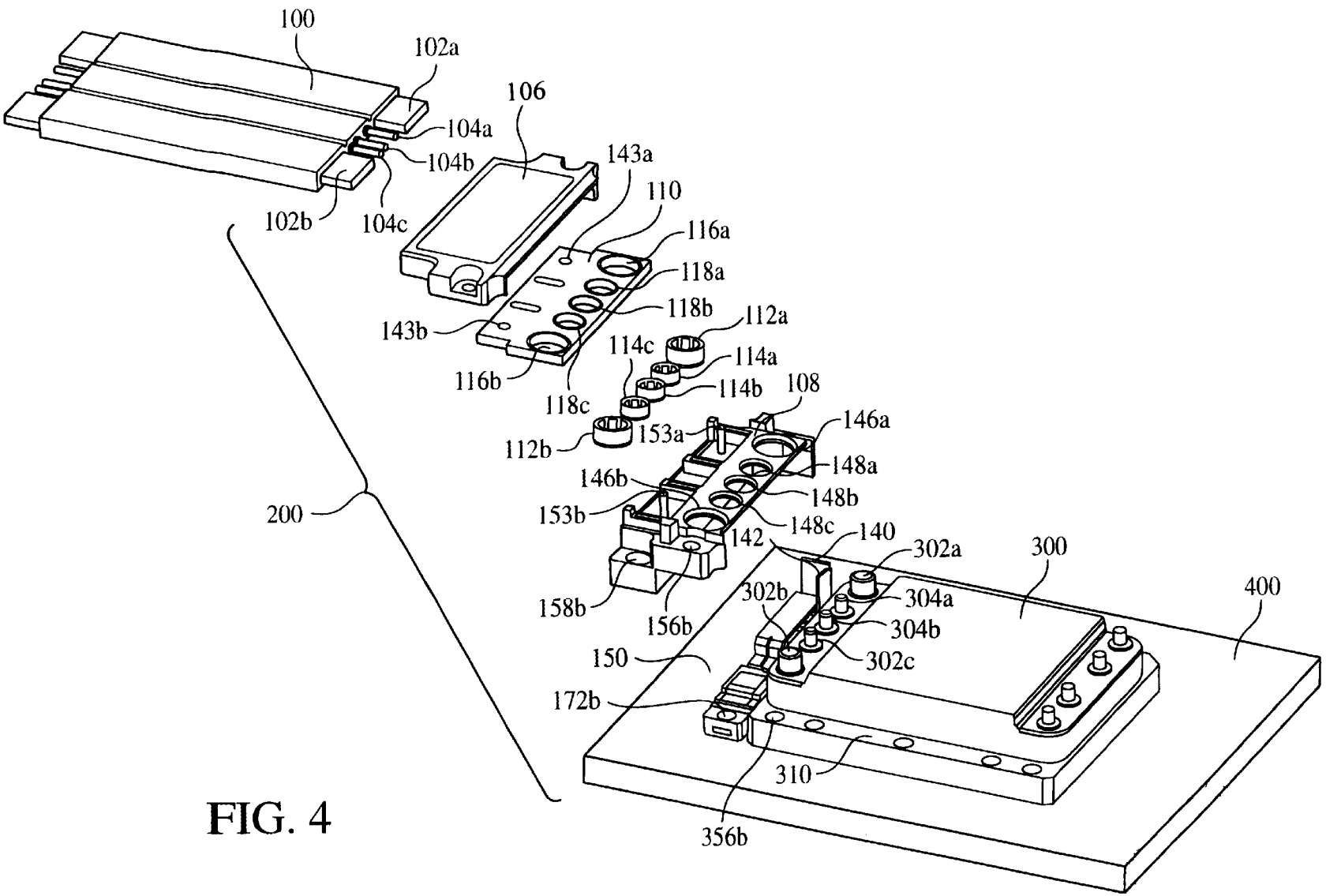
FIG. 4 is an exploded view of the connector assembly of FIGS. 2A and 2B mounted on a heat sink and a power converter.

Referring to FIG. 4, socket connectors 112*a*, 112*b* and 114*a*, 114*b*, 114*c* are soldered into openings 116*a*, 116*b* and 118*a*, 118*b*, 118*c*, respectively, on the PCB assembly 110. The socket connectors 112*a*, 112*b* and 114*a*, 114*b*, 114*c* are described in U.S. patent application 08/744, 110, assigned to the same assignee as this application, the entire disclosure of which is incorporated herein by reference. The conductive traces 402*a*, 402*b*, and 404*a*, 404*b*, 404*c*, and the corresponding traces to which they are attached on the bottom surface 111 of the PCB, are electrically connected to the socket connectors 112*a*, 112*b* and 114*a*, 114*b*, 114*c*, respectively.

Figure 5:
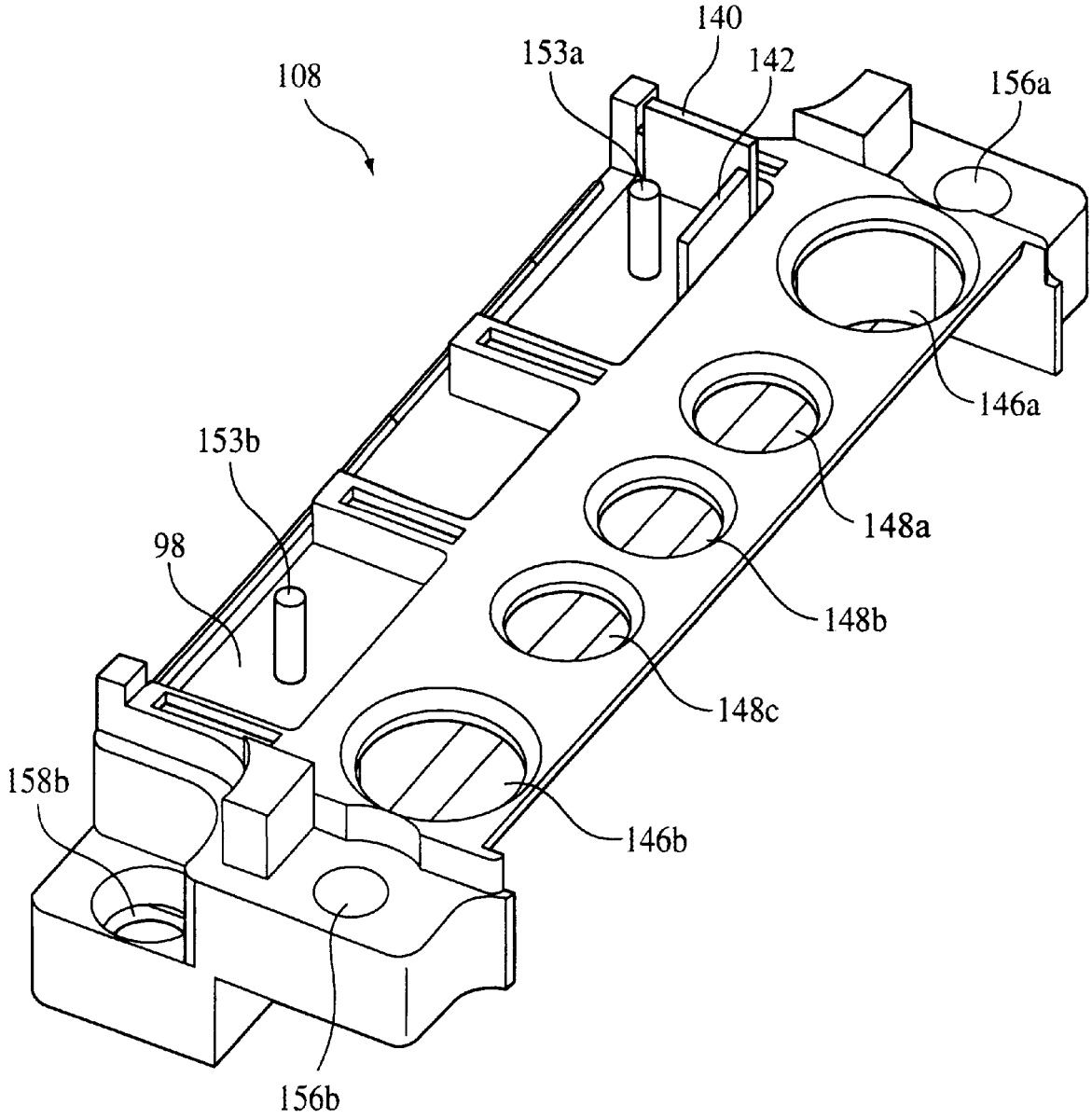
FIG. 5 is a perspective view of a housing.

The PCB assembly 110 is mounted on top of the housing 108, shown also in FIG. 5. Pins 153*a* and 153*b*, featured on the top surface 98 of the housing 108, are inserted into openings 143*a* and 143*b* of the PCB assembly 110 (shown in FIGS. 4 and 11) to align the PCB assembly 110 on top of the housing 108. The socket connectors 112*a*, 112*b* and 114*a*, 114*b*, 114*c* are exposed via openings 146*a*, 146*b* and 148*a*, 148*b*, 148*c*, respectively, formed in the housing 108.

Figure 6:
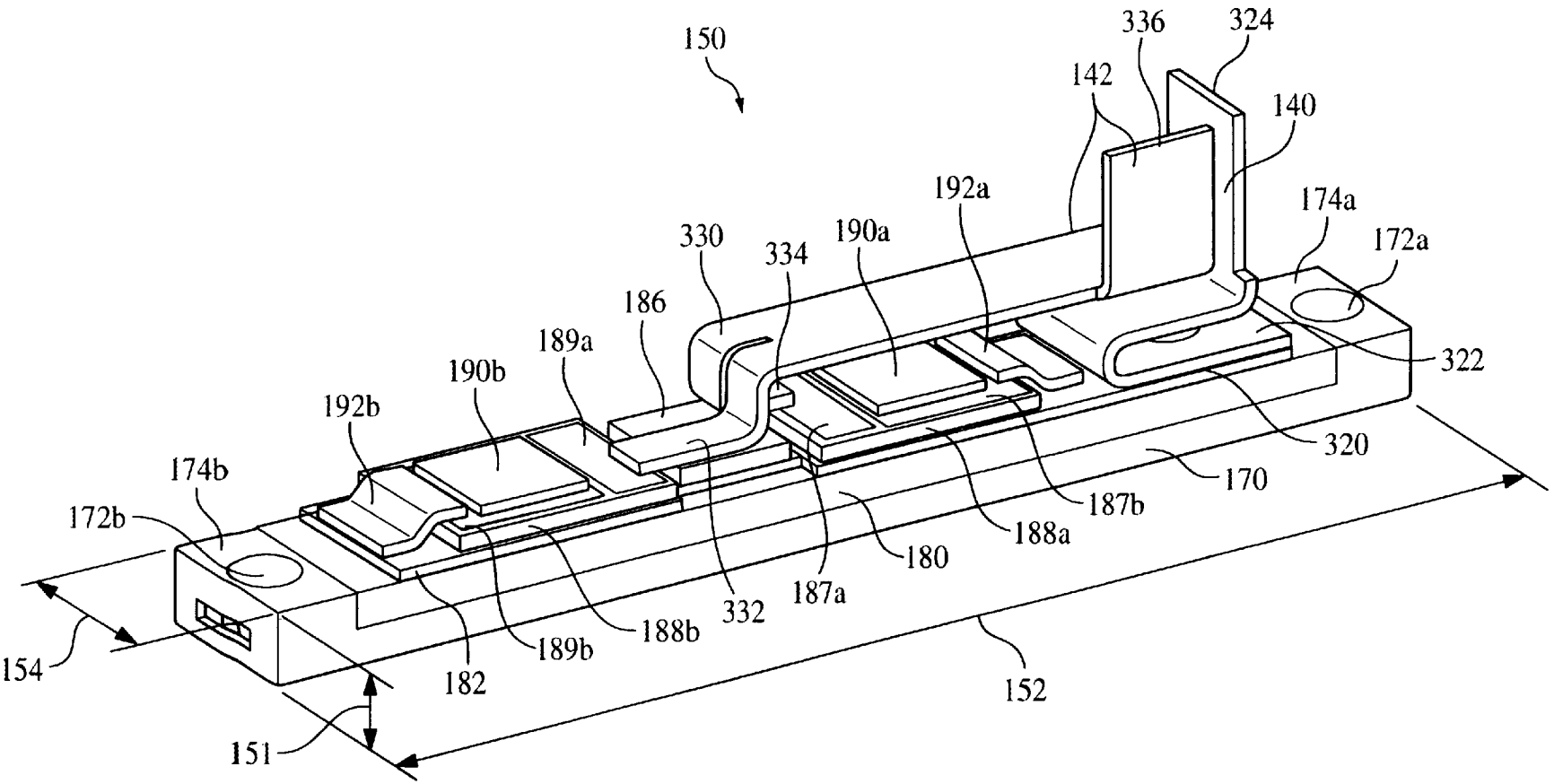
FIG. 6 is a perspective view of a component interface subassembly.
Figure 11:
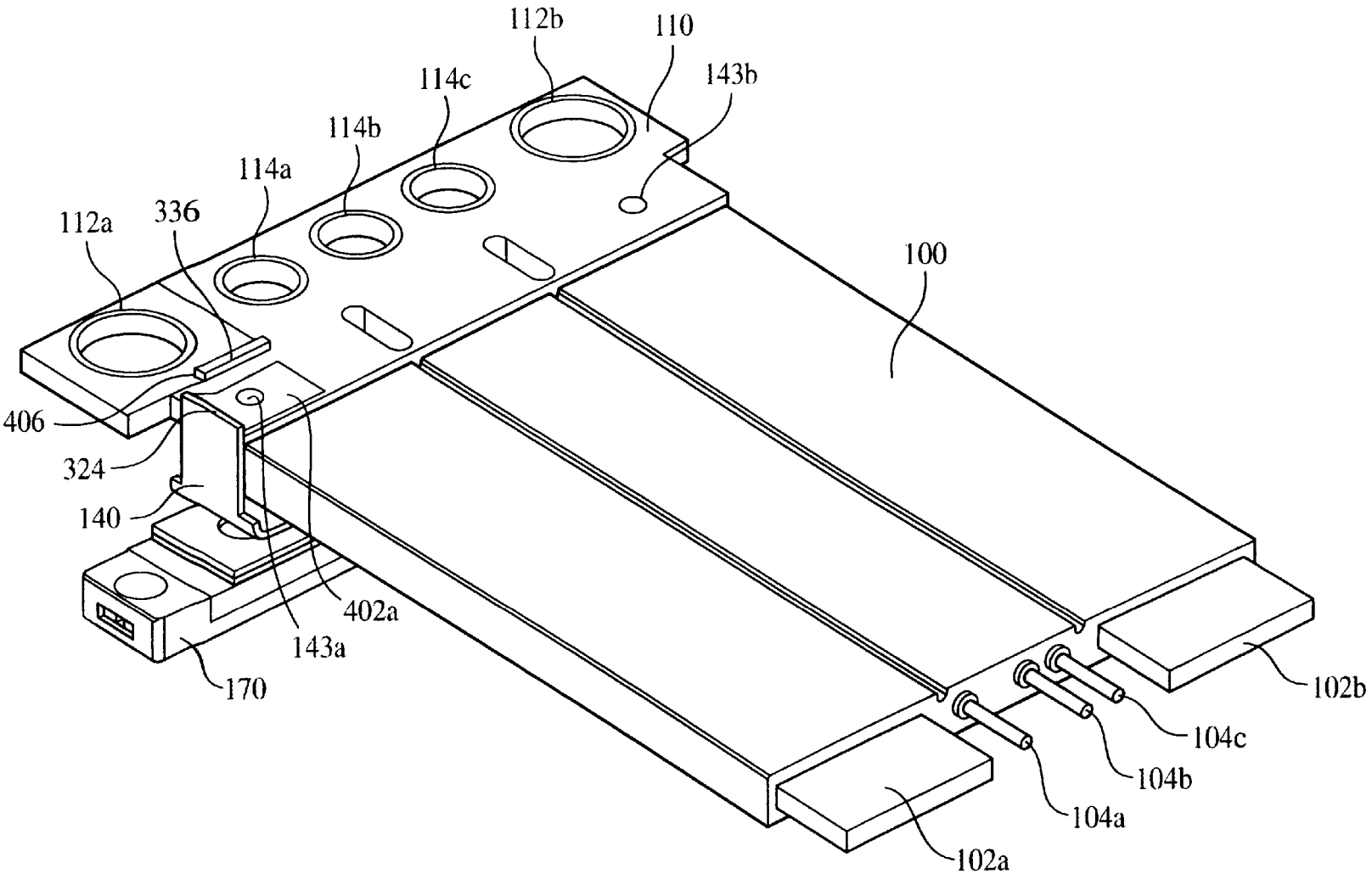
FIG. 11 is a perspective view of the internal construction of a connector assembly.

In the embodiment of FIGS. 3 and 6, electronic components in the form of a pair of OR diodes are connected in parallel with each other and in series with the power converter output and the load. The component interface subassembly 150 includes the thermally conductive plate 170, OR diode dies 190*a*, 190*b* a cathode busbar 140 and an anode busbar 142. As shown in FIG. 11, end 324 of the cathode busbar 140 is soldered to conductive trace 402*a*, thereby connecting the cathode busbar to load wire 102*a*. End 336 of the anode busbar 142 is soldered to plated through slot 406 in the PCB assembly 110. Slot 406 is electrically connected to socket 112*a* (FIG. 11), which connects to an output pin of a power converter. In this way, the connector assembly 200 connects an OR diode in series between a power converter output and a load.

Figure 7:
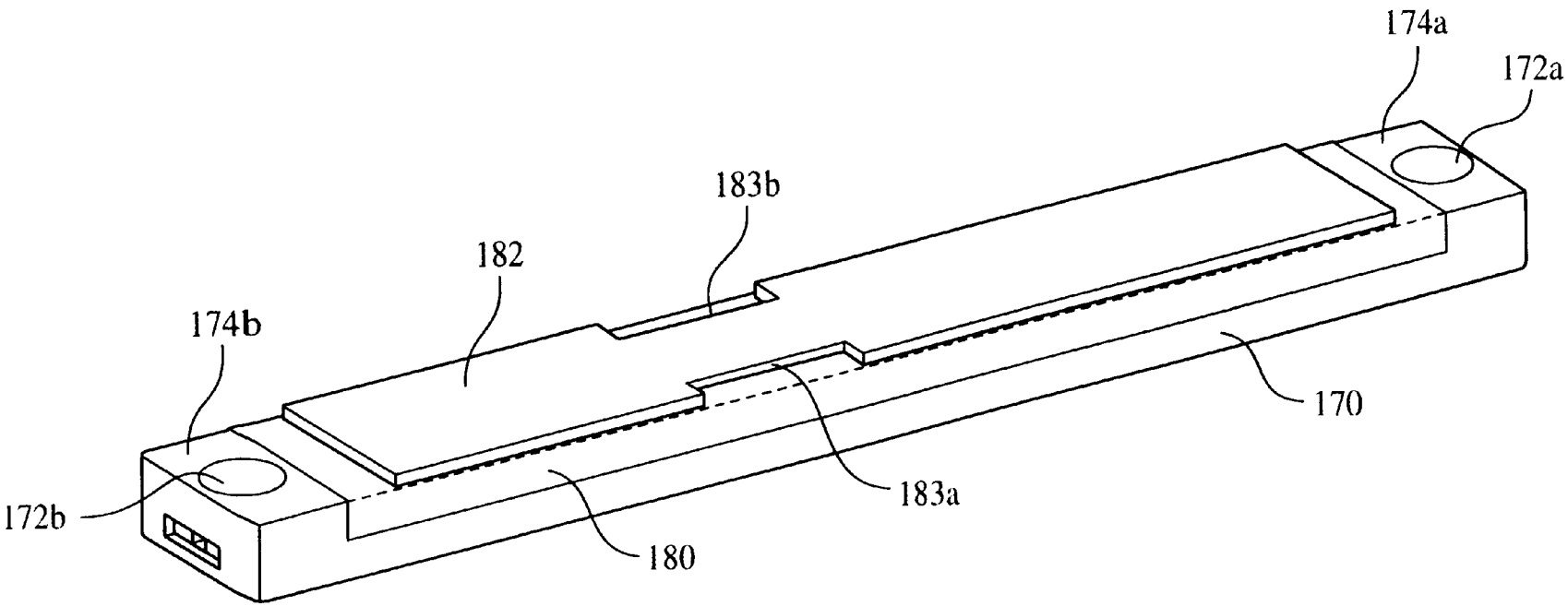
FIG. 7 is a perspective view of a portion of a component interface subassembly.

The thermally conductive plate 170, shown also in FIG. 7, is a rectangle made of aluminum or zinc and has opposite ends 174*a* and 174*b*. Feedthrough openings 172*a* and 172*b* are located on the opposite ends 174*a* and 174*b*, respectively. Aluminum or zinc is used as the plate material because they have good thermal conductivity and are easy to cast and machine. In one example, the plate 170 has a height 151 of 0.122 inch, a length 152 of 2.150 inch, and a width 154 of 0.315 inch. The top surface of the plate 170 is coated with an electrically insulating layer 180, made of thermally conductive polyimide tape, such as Kapton® tape, manufactured by Dupont Films, Circleville, Ohio, USA (FIG. 7). In one example the thickness of the insulation layer is 0.001 inch, providing sufficient dielectric strength to electrically insulate the plate 170 from a conductive layer 182.

Figure 8:
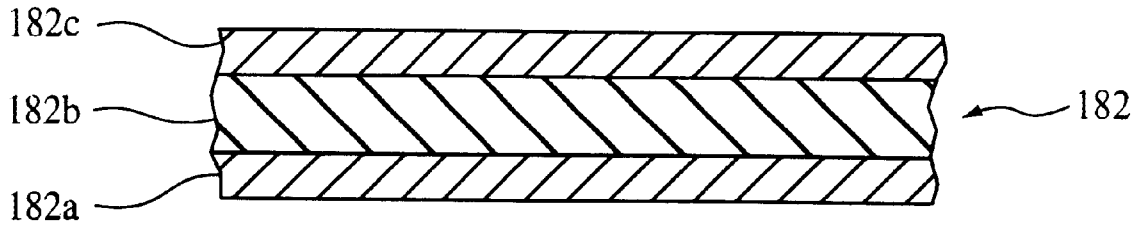
FIG. 8 is a cross-sectional view of a "tri-clad" laminate conductive layer.

Referring to FIG. 7, the conductive layer 182, a rectangle with parallel sides and cut-outs 183*a* and 183*b*, is made of a "tri-clad" copper laminate, manufactured by Clad Metal Special, Bayshore, N.Y., USA. The "tri-clad" laminate (FIG. 8) has a thickness of 0.018 inch and includes a layer of aluminum 182*a*, an interliner layer of copper 182*b*, and a layer of silver 182*c*. The layer of aluminum 182*a* is in direct contact with the insulating layer 180. The copper layer 182*b* prevents separation of the silver layer 182*c* from the aluminum layer 182*a* and contributes to the thermal conductivity of the conductive layer 182. Other materials, such as nickel, may be used as an interliner to prevent the separation of aluminum from silver, but copper has the advantage of a high thermal conductivity. The conductive layer 182, the insulating layer 180 and the plate 170 are bonded by applying pressure combined with heat, as described in U.S. Pat. No. 5,722,580, assigned to the same assignee as this application, incorporated herein by reference.

Figure 9:
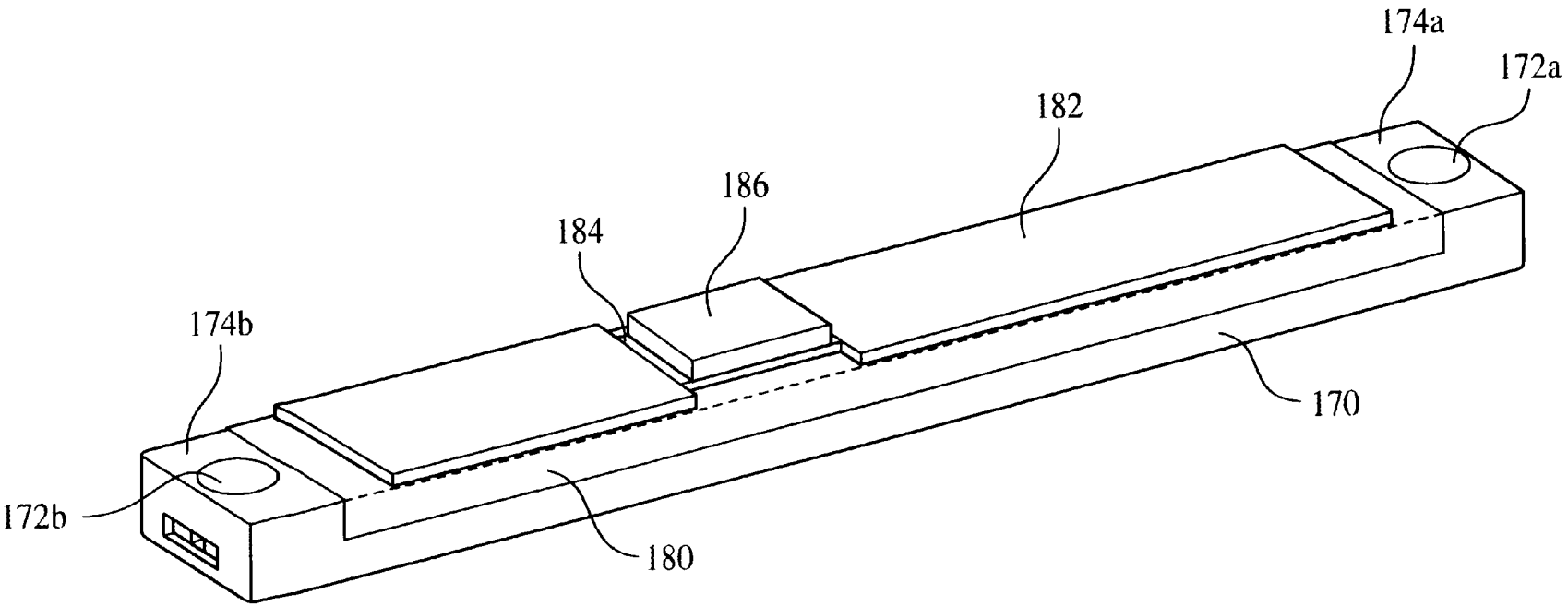
FIG. 9 is a perspective view of another portion of a component interface subassembly.

Referring to FIG. 9, an insulating layer 184, made of Kapton® tape with a thickness of 0.001 inch is placed on top of the conductive layer 182 at the location of the cut-outs 183*a* and 183*b*. A conductive spacer 186, made of copper with a thickness of 0.030 inch is placed on top of the insulating layer 184. The copper spacer 186 and the insulating layer 184 are bonded to the plate assembly by the heat and pressure process mentioned above.

Figure 1:
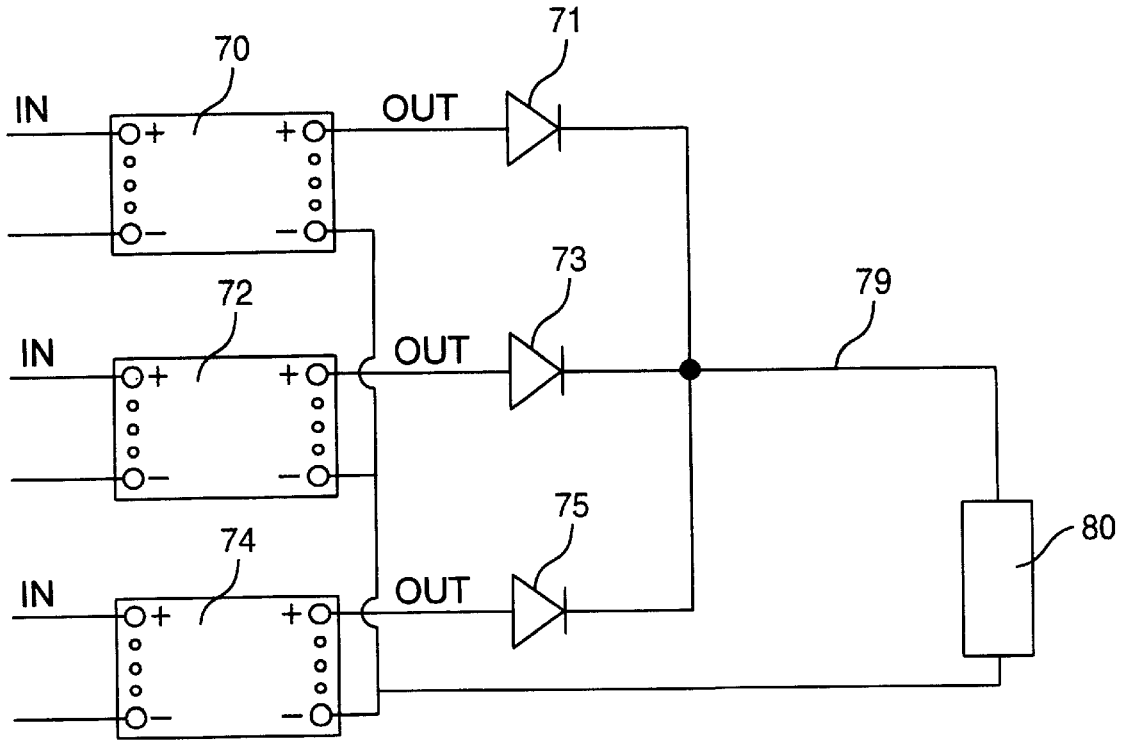
FIG. 1 is a schematic diagram of a three-module power converter array.
Figure 10A:
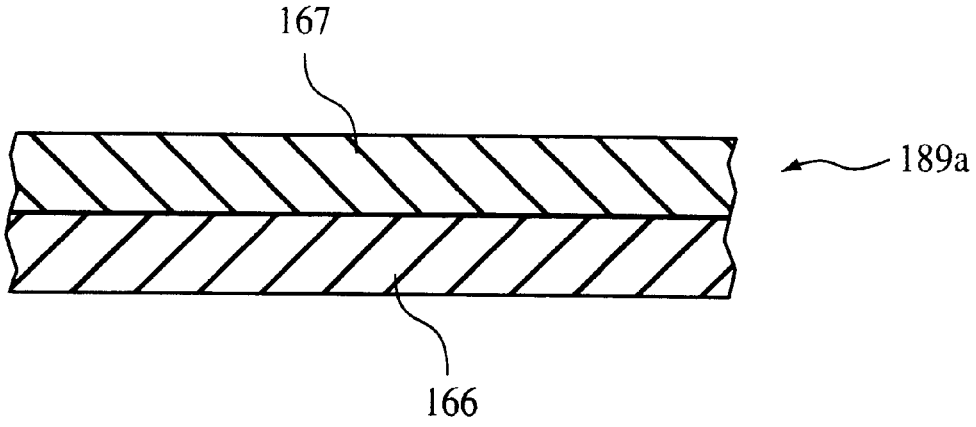
FIG. 10A is a cross-sectional view of a pad.
Figure 10:
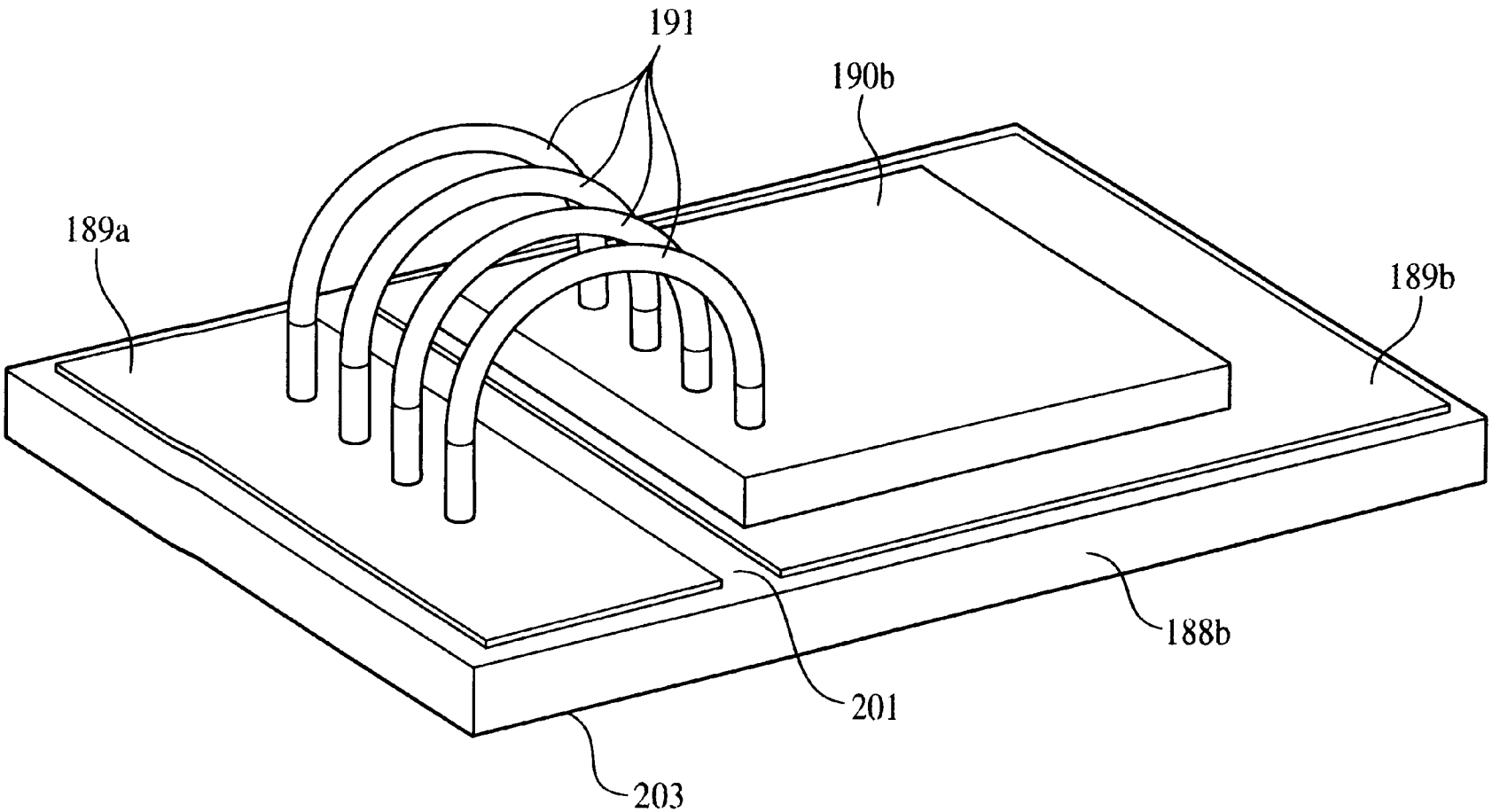
FIG. 10 is a perspective view of a ceramic substrate with an OR diode mounted on it.

Referring again to FIG. 6, the bottom cathode surfaces of the two diode die 190*a*, 190*b* are mounted on ceramic substrates 188*a* and 188*b*, respectively. Referring to FIG. 10, the top surface 201 of the ceramic substrate 188*b* has an anode pad 189*a* and a cathode pad 189*b*. The cathode pad 189*b* and the anode pad 189*a* have a copper layer 166 (shown in FIG. 10A) directly bonded to the ceramic substrate through a eutectic bond and a gold layer 167 on top of the copper layer. The diode 190*b* is connected to the anode pad 189*a* via bond wires 191 and to the cathode pad 189*b* via a eutectic bond to the gold layer 167 (not shown). Copper (not shown) is also directly bonded to the bottom surface 203 of the ceramic substrate and plated over with a film of gold. Referring again to FIG. 6, the pads 187*b*, 189*b* are connected to the conductive layer 182 via conductive straps 192*a* and 192*b*, respectively, using solder. The metallic film on the bottom layer of the ceramic substrate is soldered to the conductive layer, thereby producing a low thermal impedance bond. The end 322 of the cathode busbar 140 is also soldered to the conductive layer 182 along the interface 320. As mentioned above, end 324 of the cathode busbar 140 is soldered to the PCB assembly 110, shown in FIG. 11. The anode busbar 142, shown in FIGS. 6 and 11, has an end 330 with two legs 332 and 334 that are soldered to the two anode pads 189*a* and 187*a*, respectively, and as mentioned earlier, end 336 of the anode busbar 142 provides a common output to the PCB assembly 110 (FIG. 11). The two diodes 190*a* and 190*b* are connected in parallel to each other, forming a composite diode which is in series with the load 80, as schematically illustrated in FIG. 1. One connector assembly may be employed for each power converter module in an array.

When mounted as shown in FIG. 6, and as described above, a low thermal impedance path is provided between the diode die 190*a*, 190*b* and the thermally conductive plate 170.

Figure 12:
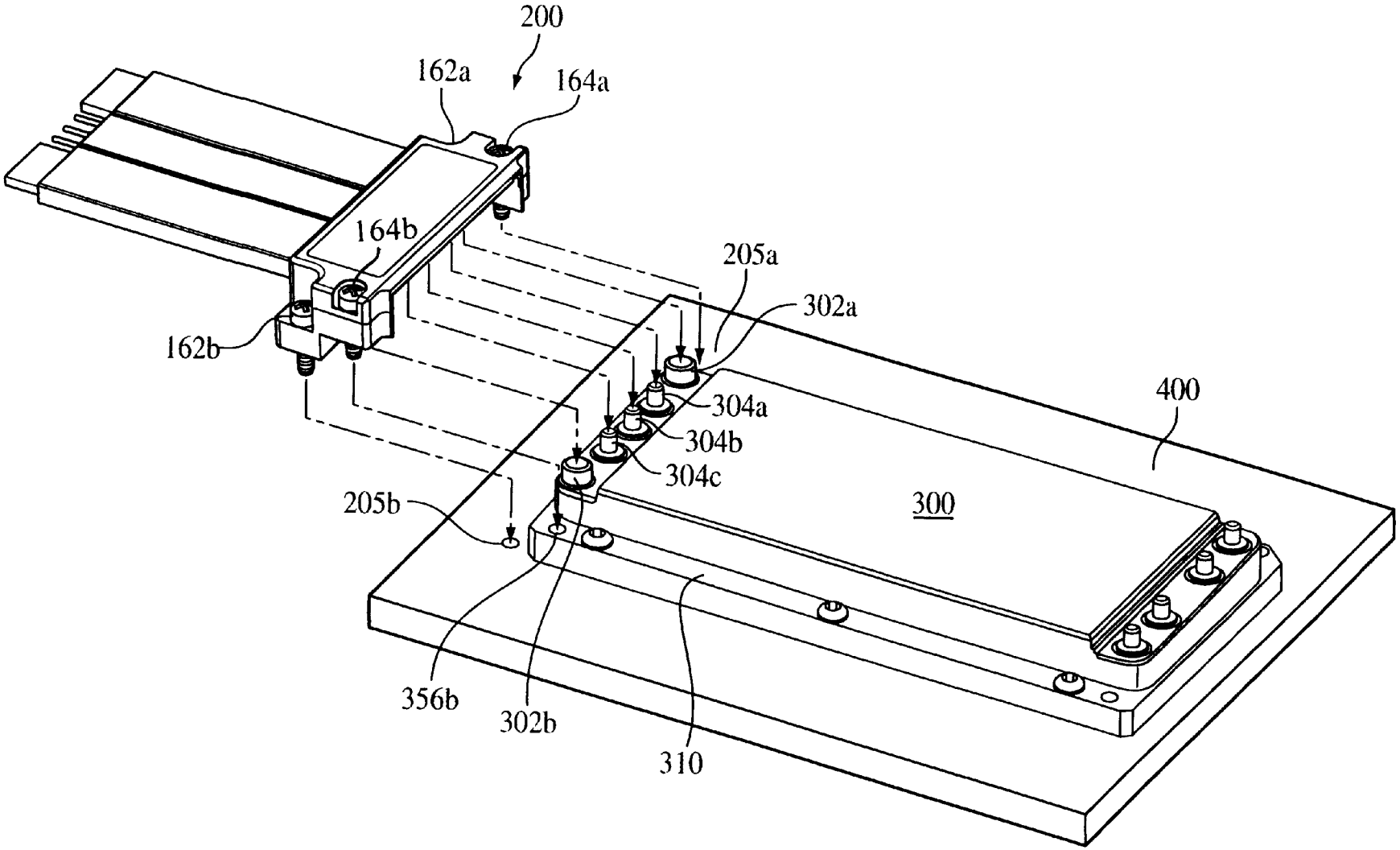
FIG. 12 is an exploded perspective view of a an assembly comprising a connector assembly, a power converter and a heat sink.

Referring to FIG. 12, a power converter 300 is mounted to a heat sink plate 400. A connector assembly 200 is installed by inserting the power converter output pins 302*a*, 302*b* and 304*a*, 304*b*, 304*c*, into the connectors 112*a*, 112*b* and 114*a*, 114*b*, 114*c*, respectively (shown in FIG. 2B). Screws 162*a* and 162*b* (also shown in FIGS. 2A and 2B), provided on the sides of the housing 108, engage with threaded holes 205*a*, 205*b* in the heat sink 400, to secure the connector assembly 200 onto a heat sink. Screws 164*a* and 164*b* (also shown in FIGS. 12 and 13), also provided on the sides of the housing 108, engage with threaded holes in the baseplate 310 of the power converter (one such hole, 356*b* is shown in FIG. 12) to secure the connector assembly 200 to the baseplate. When mounted as shown in FIG. 12, the thermally conductive plate 170 is in contact with the heat sink plate 400. As shown in FIG. 6, both the PCB anode busbar 142 and cathode busbar 140 connectors (FIG. 6) are formed with bends which provide spring action, allowing the plate 170 to move within the housing 108 by 0.015 to 0.020 inches.

Figure 14:
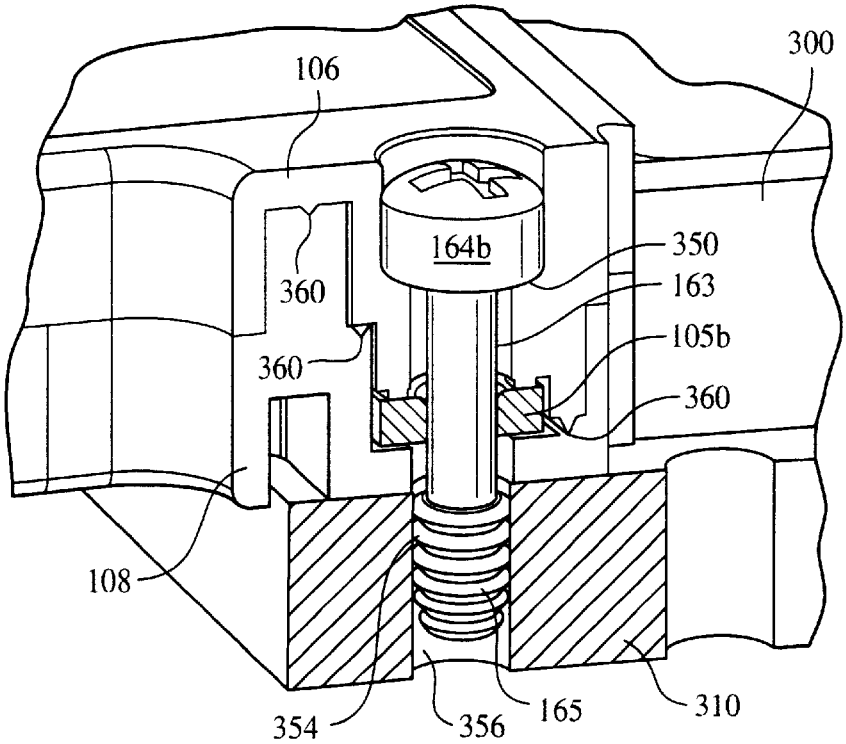
FIGS. 14 and 15 are expanded cross-sectional side views of the connector assembly mounted on a power converter.
Figure 15:
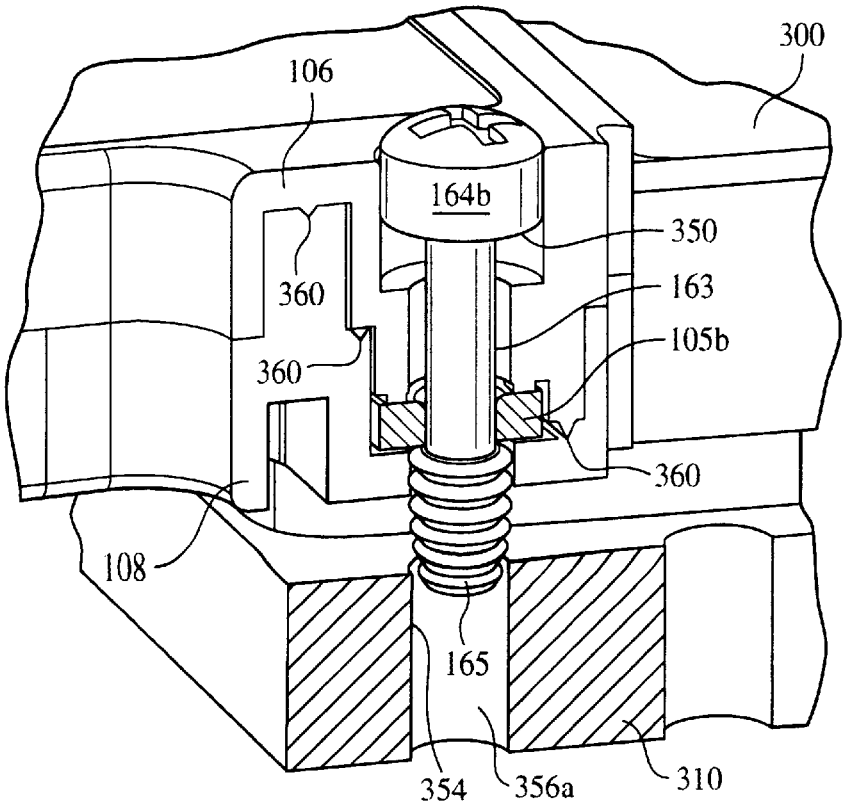

The low thermal impedance path which is provided between the diode die 190*a*, 190*b* and the thermally conductive plate 170 and the direct connection of the thermally conductive plate 170 to the heat sink plate 400 provides an efficient means of cooling the OR diodes contained within the connector assembly 200. Referring to FIGS. 4, 12, 14 and 15, the power converter 300 is mounted adjacent to the component interface subassembly 150 and the socket connectors 112*a*, 112*b*, 114*a*, 114*b*, 114*c* are aligned over the power converter output pins 302*a*, 302*b*, 304*a*, 304*b*, 304*c*, respectively. Screws 164*a* and 164*b* are clock wise rotated to engage matching threads 354 in threaded openings 356*a* (not shown) and 356*b*, respectively, in the baseplate 310 of the power converter 300. By advancing the two screws 164*a*, 164*b*, longitudinally into the corresponding openings 356*a*, 356*b* the undersides of the screw heads 350 contact the housing 108 and guide and push the socket connectors 112*a*, 112*b* and 114*a*, 114*b*, 114*c* onto the power converter output pins 302*a*, 302*b*, and 304*a*, 304*b*, 304*c*, respectively (FIGS. 14 and 4). This engages the diode socket connectors to the power converter output pins and secures the connector assembly 200 onto the power converter 300.

Figure 13:
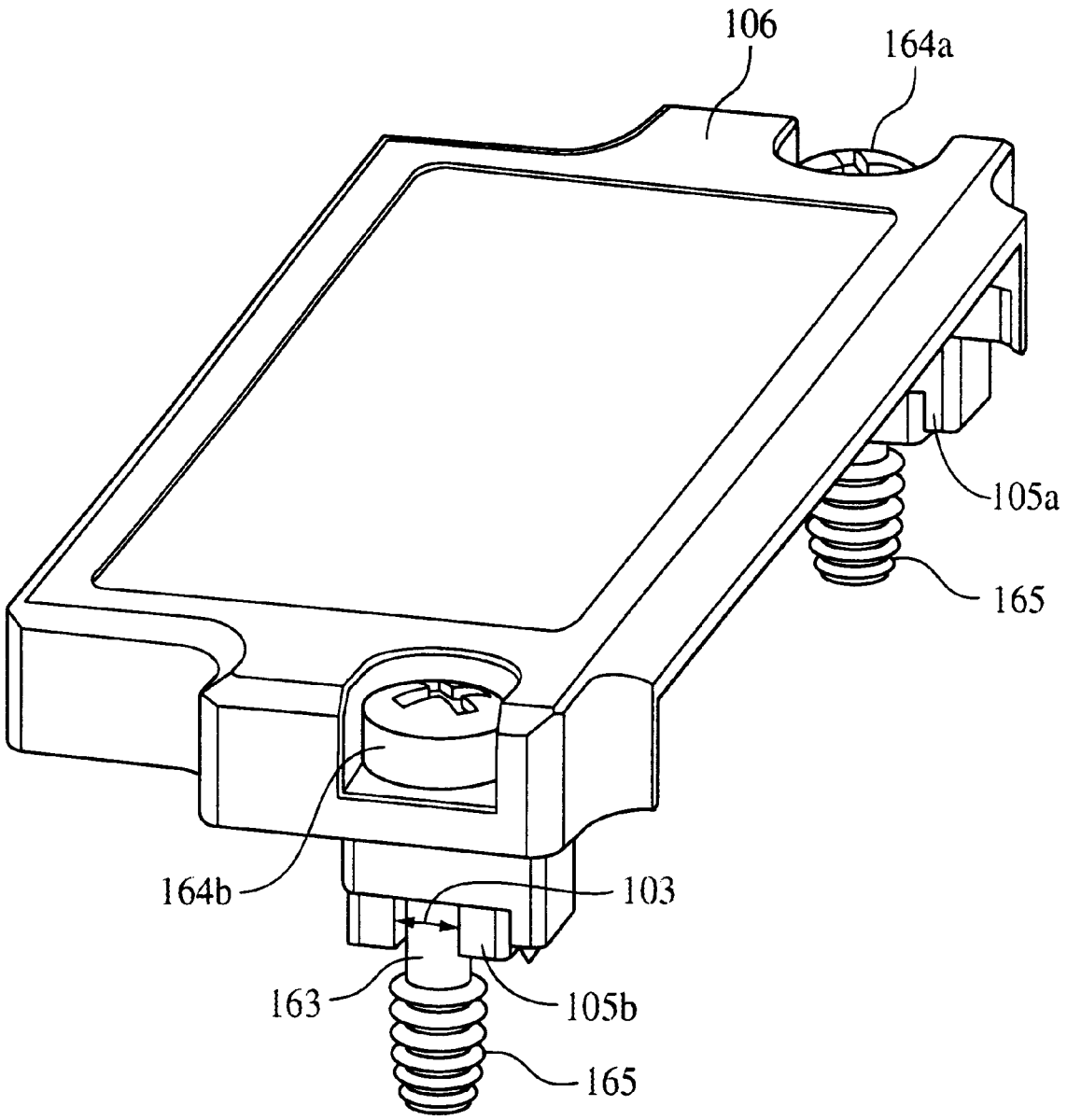
FIG. 13 is an exploded view of a cover.

The connector assembly 200 is quickly dismounted from the heat sink 400 and the power converter 300 by first turning counter clock wise screws 162*a*, 162*b*, removing them, and then turning counter clock wise screws 164*a*, and 164*b*. As shown in FIG. 12, as the threads 165 emerge from the power converter baseplate openings 356*a*, 356*b*, respectively, they encounter metal washers 105*a*, 105*b* that are permanently fixed between the housing 108 (FIG. 15) and the cover 106 along the respective feedthrough openings 158*a*, 158*b*. As the screws 164*a*, 164*b* are further retracted, the diode connectors 112*a*, 112*b* and 114*a*, 114*b*, 114*c* are lifted and become disengaged from the corresponding power converter pins, 302*a*, 302*b*, and 304*a*, 304*b*, 304*c*, respectively. Once the screws 164*a*, 164*b* are fully disengaged the connector assembly 200 can be freely removed from the power converter 300. The metal washers 105*a* and 105*b* (FIGS. 13, 14, and 15) provide a support against which the pulling force is applied. The metal washers 105*a*, 105*b* are U-shaped and the diameter of their inner opening 103 is smaller than the diameter of the threaded portion 165 of the screws 164*a*, 164*b*, but larger than the diameter of the smooth portion 163 (FIG. 13). The washers surround the smooth portion 163 of the screws 164*a* and 164*b*, respectively. They are inserted between the bottom surface of cover 106 and the top surface of housing 108 prior to the ultrasonic welding of the two pieces along the lines 360. This allows the smooth portion 163 of the screws 164*a*, 164*b* to slide up and down but prevents the threaded portion 165 of the screws to move up past the washers 105*a* and 105*b*. In this way the screws 164*a*, 164*b* are held within the connector assembly 200.

Figure 16:
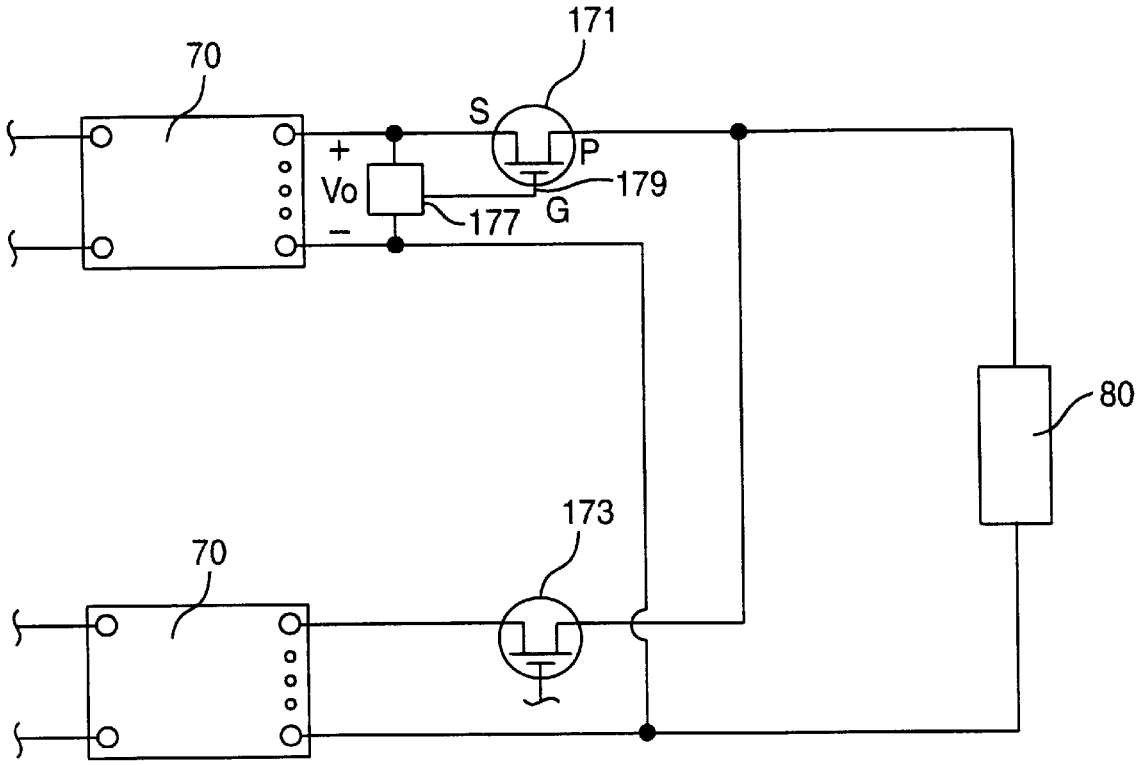
FIG. 16 is a schematic of a two module power converter array.

Other embodiments are within the scope of the following claims. The component interface subassembly may incorporate semiconductors other than OR diodes or it may incorporate other electronic components (resistors, capacitors). The array of FIG. 16, for example, includes MOSFET switches 171, 173 instead of OR diodes (which, in certain applications, may provide lower dissipative loss than diodes). Each MOSFET can be mounted within the connector assembly 200 on a ceramic substrate (e.g. substrate 188*a*, FIG. 6), as described above for the OR diode. Since a MOSFET has three terminals (gate, drain and source), the substrate would provide three connecting pads and power and control signals would be routed to these pads using conductive straps (e.g., strap 192*b*, FIG. 6), busbars (e.g., busbars 140, 142, FIG. 6), or wire bonds (e.g., wirebonds 191, FIG. 10), as also described above.

Additional components can also be mounted within the connector assembly. For example, in FIG. 16, a switch driver 177 will be required if switch 171 is an N-channel enhancement mode MOSFET. The driver 177 generates a voltage which is greater than the output voltage, Vo, of the converter. This voltage is applied to the gate terminal 179 of the MOSFET to turn the MOSFET on. Alternatively, the MOSFETs 171, 173 might be depletion mode devices with their gates connected across the converter output, or, where the converter output is too large, connected to a divider circuit connected across the converter output. The switch driver 177 might comprise semiconductor control devices, resistors, capacitors and other components, which can be mounted to a ceramic substrate using known assembly methods. The substrate would be installed in the connector assembly 200 as described above.

Aluminum alloys with zinc or copper may be also used for the base plate 170. The connector assembly may include components which are connected to sockets which connect to control pins on the power converter. More than two electronic components may be included within the connector assembly; a plurality of ceramic substrates may also be used.

What is claimed is:

1. An apparatus for providing a power connection between a power converter and a load comprising:

a connector for physically interfacing with a power output terminal on the power converter to establish a removable electrical connection to the power output terminal;

an output termination for making an electrical connection to the load;

a component interface subassembly comprising an electronic component connected in series between the connector and the output termination to restrict the current flow in the power connection to one direction between said connector and said termination; and an enclosure receiving the component interface subassembly and the connector wherein the apparatus is adapted to deliver power from the output terminal of the power converter to the load.

2. The apparatus of claim 1 further comprising a wire for delivering power to the load having a first end connected to the output termination and a second end for connection to the load.

3. An apparatus for providing a power connection between a power converter and a load comprising:

a connector for physically interfacing with a power output terminal on the power converter to establish a removable electrical connection to the terminal;

an output termination for connection to the load;

a component interface subassembly comprising a power-dissipating electronic component electrically connected to the connector and the output termination, and a heat conductor thermally connected to the power-dissipating component and providing a low thermal impedance path between the electronic component and an external surface of the apparatus; and wherein the electronic component is adapted to be electrically connected to the power converter and the load through the connector and output termination and thermally connected to a heat sink through the heat conductor.

4. The apparatus of claim 3 further comprising a wire having one end for connection to the load.

5. The apparatus of claim 4 wherein a second end of the wire is connected to the connector.

6. The apparatus of claim 4 wherein a second end of the wire is connected to the electronic component.

7. The apparatus of claim 3 further comprising an enclosure receiving the component interface subassembly and the connector.

8. An apparatus for electrically connecting a first device and a second device comprising:

a circuit board having an output termination for making an electrical connection to the second device and a connector for physically interfacing with an output terminal of the first device to establish a removable electrical connection to the output terminal;

a component interface subassembly comprising a thermally conductive substrate and a power-dissipating electronic component mounted on the substrate, the substrate being mechanically separate from the circuit board; and an enclosure receiving the component interface subassembly and the circuit board.

9. The apparatus of claim 8 wherein the substrate further comprises an external mounting surface being coplanar with a base plate of the first device when the connector is mated with the output terminal of the first device.

10. The apparatus of claim 8 further comprising a conductive strap bridging a distance between the subassembly and the circuit board and providing electrical connection between the substrate and the circuit board.

11. The apparatus of claim 8 further comprising a resilient bias member resiliently biasing the subassembly toward a heat sink surface adapted for receiving a base plate of the first device, the subassembly being spaced apart from the circuit board to provide a profile compatible with the first device.

12. The apparatus of claim 11 wherein the resilient member comprises at least one conductive strap connected to subassembly and to the circuit board and providing electrical connection between the subassembly and the circuit board.

13. The apparatus of claim 1, 3, or 8 wherein the electronic component comprises a diode.

14. The apparatus of claim 1, 3, or 8 wherein the electronic component comprises a MOSFET.

15. The apparatus of claim 1, 3, or 8 wherein the component interface subassembly connects the electronic component to the connector.

16. The apparatus of claim 1, 8, or 9 wherein the output termination further comprises a wire.

17. The apparatus of claim 16 wherein the wire is part of a cable comprising insulated wires.

18. The apparatus of claim 1 or 8 wherein the component interface subassembly further comprises a thermally conductive plate.

19. The apparatus of claim 18 wherein the electronic component is thermally coupled to the thermally conductive plate.

20. The apparatus of claim 19 wherein the electronic component comprises a semiconductor diode.

21. The apparatus of claim 18 wherein a surface of the thermally conductive plate forms a portion of an outside surface of the apparatus.

22. The apparatus of claim 1 or 7 wherein the enclosure comprises a body having a top surface, a bottom surface and at least one opening passing through said top surface and said bottom surface and being adapted to receive a fastener for securing the apparatus to another device.

23. The apparatus of claim 22 wherein the apparatus is adapted to receive the fastener for securing the apparatus to a heat sink.

24. The apparatus of claim 22 wherein the apparatus is adapted to receive the fastener for securing the apparatus to the power converter.

25. The apparatus of claim 22 wherein the connector is located within the enclosure and inset from an aperture in a surface of the enclosure.

26. The apparatus of claim 1 or 7 wherein the enclosure further comprises at least one opening adapted to receive and retain a fastener for securing the apparatus to the power converter.

27. The apparatus of claim 26 wherein said fastener comprises a screw having a head, and an elongated member attached to the head said elongated member having a smooth portion adjacent to the head and a threaded portion.

28. The apparatus of claim 27 wherein the threaded portion of the screw is adapted to engage a threaded opening of a power converter for advancing the screw in a longitudinal direction into the threaded opening and engaging the connector with an output pin of the power converter when the screw is rotated in one direction and for with drawing the threaded portion of the screw in a longitudinal direction out of the threaded opening and disengaging the connector from the output pin of the power converter. when rotated in the opposite direction.

29. The apparatus of claim 28 further comprising a washer surrounding said smooth portion of the screw, said washer being permanently affixed within the opening of the enclosure and having an inner diameter smaller than an outer diameter of said threaded portion thus retaining said screw within the enclosure.

30. The apparatus of claim 1, 3, or 8 wherein the component interface subassembly comprises:

a thermally conductive plate comprising top and bottom surfaces;

a first insulation layer comprising top and bottom surfaces, wherein the bottom surface is in contact with the top surface of the thermally conductive plate;

a metal layer comprising top and bottom surfaces, wherein the bottom surface is in contact with the top surface of the first insulation layer;

an insulating plate comprising top and bottom surfaces, wherein the bottom surface is in contact with the top surface of the metal layer;

a metal plate comprising top and bottom surfaces, wherein the bottom surface is in contact with the top surface of the insulating plate;

a first ceramic substrate comprising top and bottom surfaces, the bottom surface comprising a metallic film which is bonded to the top surface of the metal layer, and the top surface comprising metallic pads covered with a metallic film; and a first component mounted on the top of the first ceramic substrate surface, the first component having terminations which are connected to the pads.

31. The apparatus of claim 30 wherein the component interface subassembly further comprises:

a first conductive strap connecting a first pad on the top surface of the first ceramic substrate with the top surface of the metal layer;

a first conductive busbar comprising a first end attached to a second pad on the first ceramic substrate; and a second conductive busbar comprising a first end attached to the top surface of the metal layer.

32. The apparatus of claim 31 wherein the first conductive strap comprises copper.

33. The apparatus of claim 31 wherein the first and second conductive busbars comprise copper.

34. The apparatus of claim 31 wherein the first and second conductive busbars are adapted to provide a spring type action.

35. The apparatus of claim 34 wherein said spring type action provides for movement of the component interface subassembly relative to the enclosure.

36. The apparatus of claim 35 wherein the apparatus is adapted to have the bottom surface of the thermally conductive plate disposed for mating with an external surface, the external surface having a predetermined spatial relationship with the terminal.

37. The apparatus of claim 31 wherein the component interface subassembly further comprises:

a second ceramic substrate comprising top and bottom surfaces, the bottom surface comprising a continuous metallic film, the film providing a bond of the bottom ceramic substrate surface to the top surface of the metal layer, and the top surface comprising pads covered with a metallic film; and a second component mounted on the top surface of the second ceramic substrate, the second component having terminations which are connected to the pads.

38. The apparatus of claim 37 wherein the component interface subassembly further comprises:

a second conductive strap for connecting a first pad on the top surface of the second ceramic substrate with the top surface of the metal layer; and a second end on said first busbar for connecting to a second pad on said second ceramic substrate.

39. The apparatus of claim 37 wherein said second component comprises a diode and wherein a first pad on said second ceramic substrate is connected to the cathode of the diode and a second pad on said second ceramic substrate is connected to the anode of the diode.

40. The apparatus of claim 37 wherein said second component comprises a semiconductor control device.

41. The apparatus of claim 30 wherein said first component comprises a diode and wherein a first pad on said first ceramic substrate is connected to the cathode of the diode and a second pad on said first ceramic substrate is connected to the anode of the diode.

42. The apparatus of claim 30 wherein said first component comprises a MOSFET.

43. The apparatus of claim 30 wherein the metal layer comprises a laminate comprising a layer of silver, a layer of copper and a layer of aluminum.

44. The apparatus of claim 30 wherein the metallic film on the surface of the first ceramic substrate comprises a layer of copper in contact with the ceramic substrate and a layer of gold in contact with a surface of the copper layer opposite the ceramic substrate.

45. The apparatus of claim 3, 8, or 12, wherein the component is connected in series between the connector and the output termination to restrict current flow to one direction between the connector and the termination.

46. The apparatus of claim 8 or 9 wherein the enclosure comprises a body having a top surface, a bottom surface and at least one opening passing through said top surface and said bottom surface and being adapted to receive a fastener for securing the apparatus to another device.

47. The apparatus of claim 46 wherein the apparatus is adapted to receive the fastener for securing the apparatus to a heat sink.

48. The apparatus of claim 8 or 9 wherein the enclosure further comprises at least one opening adapted to receive and retain a fastener for securing the apparatus to the first device.

49. The apparatus of claim 8 or 9 further comprising a wire for delivering power to the second device having a first end connected to the output termination and a second end for connection to the second device.

* * * * *

UNITED STATES PATENT AND TRADEMARK OFFICE

CERTIFICATE OF CORRECTION

PATENT NO. : 6,234,842 B1
DATED : May 22, 2001
INVENTOR(S) : Patrizio Vinciarelli and Gary C. Keay It is certified that error appears in the above-identified patent and that said Letters Patent is hereby corrected as shown below:

Column 2,
Line 24, delete “a”.

Column 4,
Line 6, change “disconnected” to -- disconnect --.
Line 38, delete “a”.

Column 9,
Line 24, change “electrically connecting” to -- providing a power connection between --.

Column 10,
Line 38, change “with drawing” to -- withdrawing --.
Line 41, after “converter” delete the period.

Signed and Sealed this

Eighth Day of April, 2003

JAMES E. ROGAN
*Director of the United States Patent and Trademark Office*